United States Patent [19]

Childers

[11] Patent Number: 5,005,270

[45] Date of Patent: Apr. 9, 1991

[54] CONTINUOUS CARPET WASHING AND PILE MODIFICATION METHOD AND APPARATUS

[75] Inventor: Billy M. Childers, Calhoun, Ga.

[73] Assignee: Multitex Corporation of America, Calhoun, Ga.

[21] Appl. No.: 477,552

[22] Filed: Feb. 9, 1990

[51] Int. Cl.[5] ..... D06G 1/00

[52] U.S. Cl. ..... 26/25; 68/175

[58] Field of Search ..... 8/151; 26/25; 68/175, 68/181 R

[56] References Cited

U.S. PATENT DOCUMENTS

| | | | |
|---|---|---|---|
| 3,465,553 | 9/1969 | Muller et al. | 68/175 |
| 3,765,195 | 10/1973 | Wilson | 68/181 R X |
| 3,857,261 | 12/1974 | Wilcox | 68/175 X |
| 4,038,842 | 8/1977 | Mizutani | 68/175 X |
| 4,479,370 | 10/1984 | Wang | 68/181 R X |
| 4,702,092 | 10/1987 | Turner | 68/175 X |

FOREIGN PATENT DOCUMENTS

| | | | |
|---|---|---|---|
| 531478 | 9/1954 | Belgium | 68/181 R |

*Primary Examiner*—Werner H. Schroeder
*Assistant Examiner*—John J. Calvert
*Attorney, Agent, or Firm*—Sherman and Shalloway

[57] ABSTRACT

An apparatus and method for continuously washing and modifying a carpet pile to remove loose fibers and equalize the tension and spacing of the pile yarns to eliminate optical banding in dyed carpets. The apparatus comprises a processing tank through which the carpet web passes and which contains manipulating rollers that are provided with fins to brush against the carpet pile. Adjustable rollers push the carpet into contact with the manipulating rollers which can be rotated so as to brush the pile in opposing directions. The method involves passing the carpet through the tank in a U-shaped path such that the pile is brushed one way on the inward leg and the opposite way on the outward leg. At the bottom of the U, tension is applied against the back of the carpet to push the pile outward and aid in separation of the fibers.

16 Claims, 4 Drawing Sheets

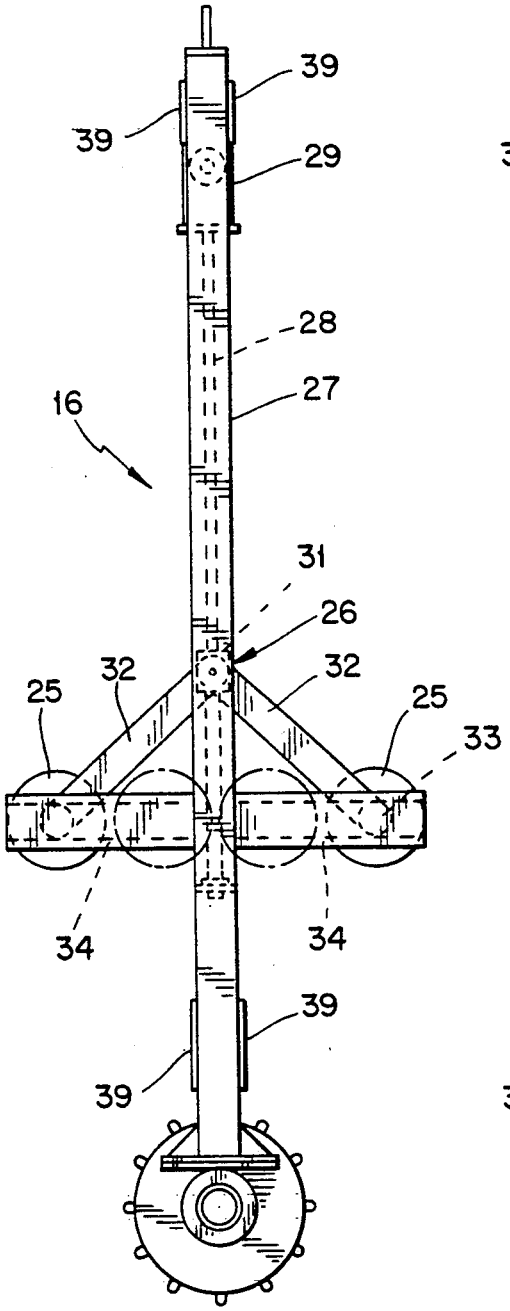
Fig. 3
Fig. 4
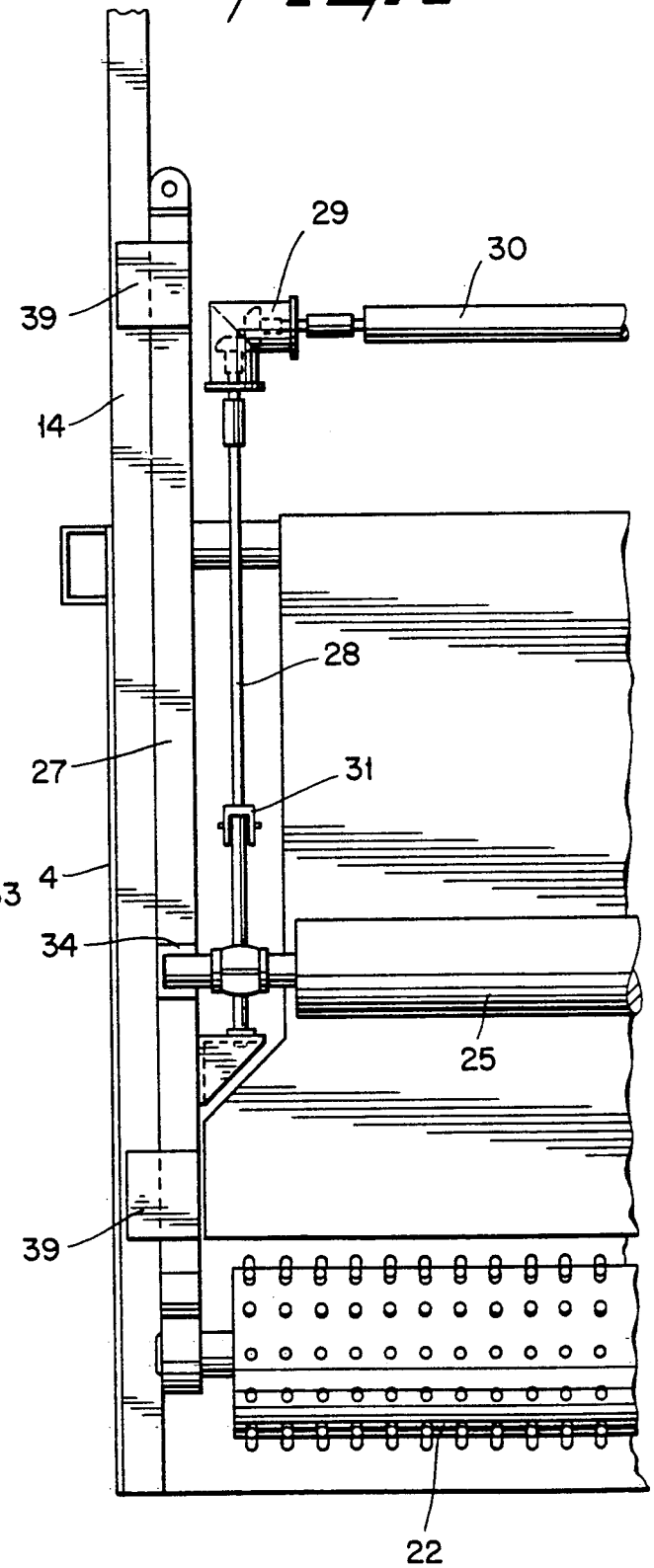

CONTINUOUS CARPET WASHING AND PILE MODIFICATION METHOD AND APPARATUS

BACKGROUND OF THE INVENTION

The dyeing of tufted carpet material has traditionally been carried out in large vats called dye becks. These becks consist of a large vessel having a circular reel positioned at the top and means to heat the vessel contents to near boiling temperatures. Typically, about 300 to 400 feet of carpet was sewn in a continuous loop around the reel and then passed through a dye liquor in the vat until the cycle of dyeing was complete, usually 3 to 4 hours. The resulting piece of carpet became a batch, or lot, of that particular color. Needless to say, matching multiple lots produced by this method closely enough to be used adjacent to each other was practically impossible.

With the growth of the carpet industry, the move was made to continuous dyeing as was the practice in the apparel textile industry. The advantages of such a method were obvious; dyeing of larger lots in a given color, greater efficiencies in labor, energy, waste control, water use and effluent handling cost. However, experience soon showed that all types of carpet did not perform equally well in continuous dyeing processes.

A particular problem related to the yarn manufacture and tufting processes and not overcome by the normal handling of the continuous process is the phenomenon of texture banding. Although this is actually an optical phenomenon related to unequal tensions or spacing of yarns, it appears to be a color difference within the fabric of the carpet and is unacceptable in applications covering large areas.

Several techniques have been employed in the industry in an effort to eliminate these texture related bands but they have met with little success. Pre-steamers, wash systems, high wet add-on as well as modification of the dyeing chemistry have proven to be ineffective. Thus, many manufacturers have continued to dye certain constructions in smaller lots in batch type apparatus or have resorted to using pre-colored yarns to produce large lots.

Accordingly, it is one object of this invention to provide an apparatus and method whereby texture banding in carpets can be overcome. It is a further object to provide an apparatus and method for washing and treating carpet pile to eliminate optical banding in dyed carpet. It is a still further object to provide an apparatus and method for use in the continuous production of dyed carpet to wash, remove loose fibers and mechanically modify pile carpet. It is a still further object to provide an apparatus and method by which the tension and spacing of carpet pile yarns may be equalized to eliminate optical banding in dyed carpets.

SUMMARY OF THE INVENTION

Briefly described, the apparatus comprises a vessel or tank for containing a processing liquid, a collection of rollers for guiding the path of the carpet through the tank and for manipulating the pile yarn and filter and drain means for treating and removing or reusing the processing liquid. The apparatus is preferably utilized in the treatment of pile carpet material with the pile surface facing outward during travel through the tank.

In the preferred embodiment, the roller collection comprises four outer fixed position manipulation rollers and a centrally oriented retractable guide and tension roller assembly. Preferably the manipulation rollers are arranged in upper and lower pairs, the rollers of each pair being positioned directly opposite each other. Alternatively, the positions of these rollers may be such as to present a staggered appearance when viewed from one end of the apparatus.

The retractable guide and tension roller assembly extends into the tank between the rollers of each pair. The assembly includes a lower guide roller around which the carpet makes a 180° turn and at least one pair of intermediate, adjustable tension rollers which urge the carpet against the manipulation rollers. Means is provided to extend and retract the tension rollers as well as to retract the entire assembly from the tank.

The interior of the tank is contoured relative to the manipulation rollers and the guide roller to provide a narrow channel between the carpet pile and the wall of the tank. Circulation of the processing liquid is counter to the direction of travel of the carpet, the liquid input occurring on the side where the carpet exits and overflow occurring on the carpet entrance side. Processing liquid overflow feeds into a side vessel for filtration and is then re-pumped to the washer or directed to the drain.

BRIEF DESCRIPTION OF THE DRAWING FIGURES

FIG. 3 is a detail of the retractable guide and tension roll assembly.

FIG. 4 is a side elevation of the guide and tension roll assembly.

DESCRIPTION OF THE PREFERRED EMBODIMENT

Figure 1:
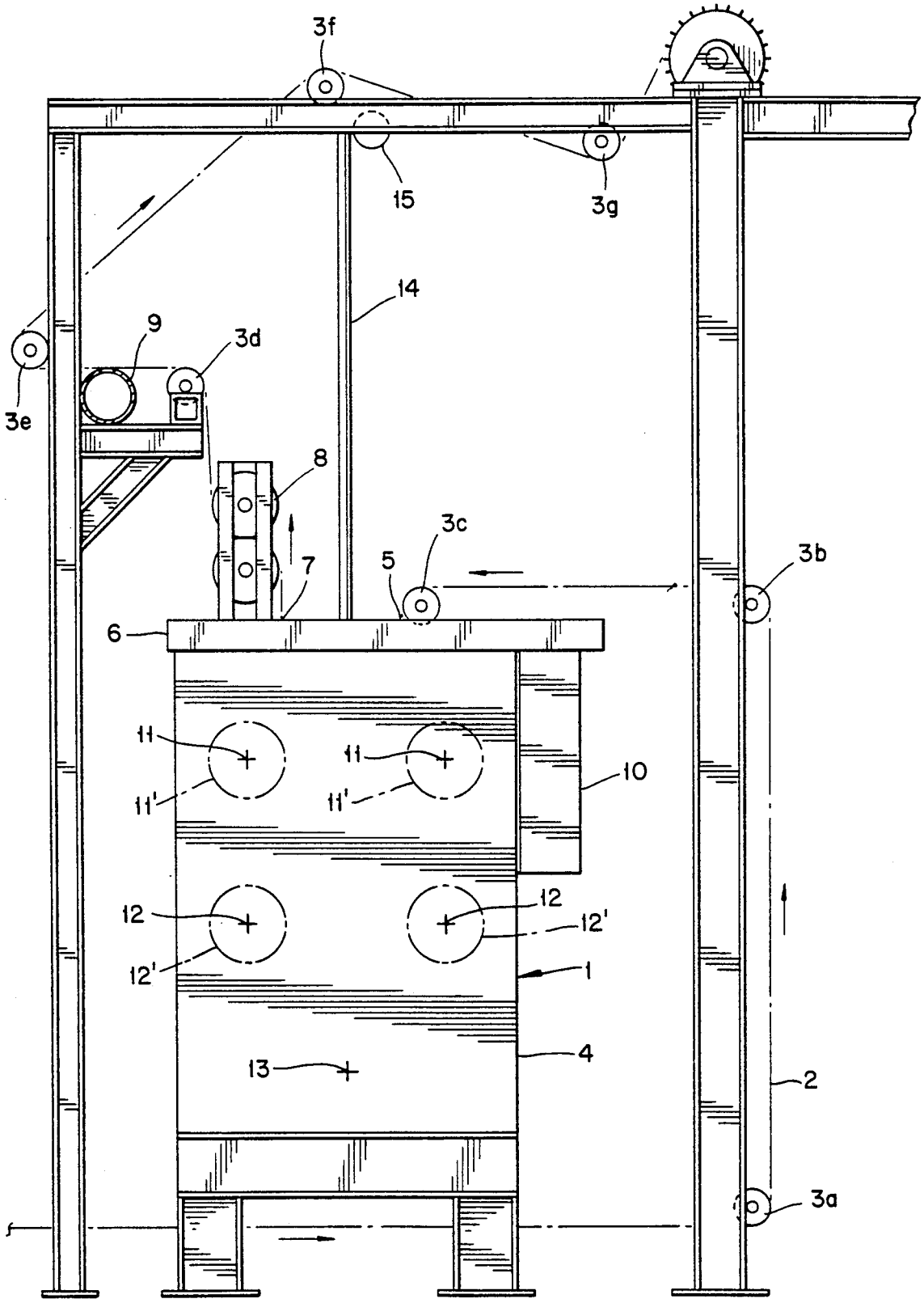
FIG. 1 is a side elevation of the apparatus of the invention.
Figure 2:
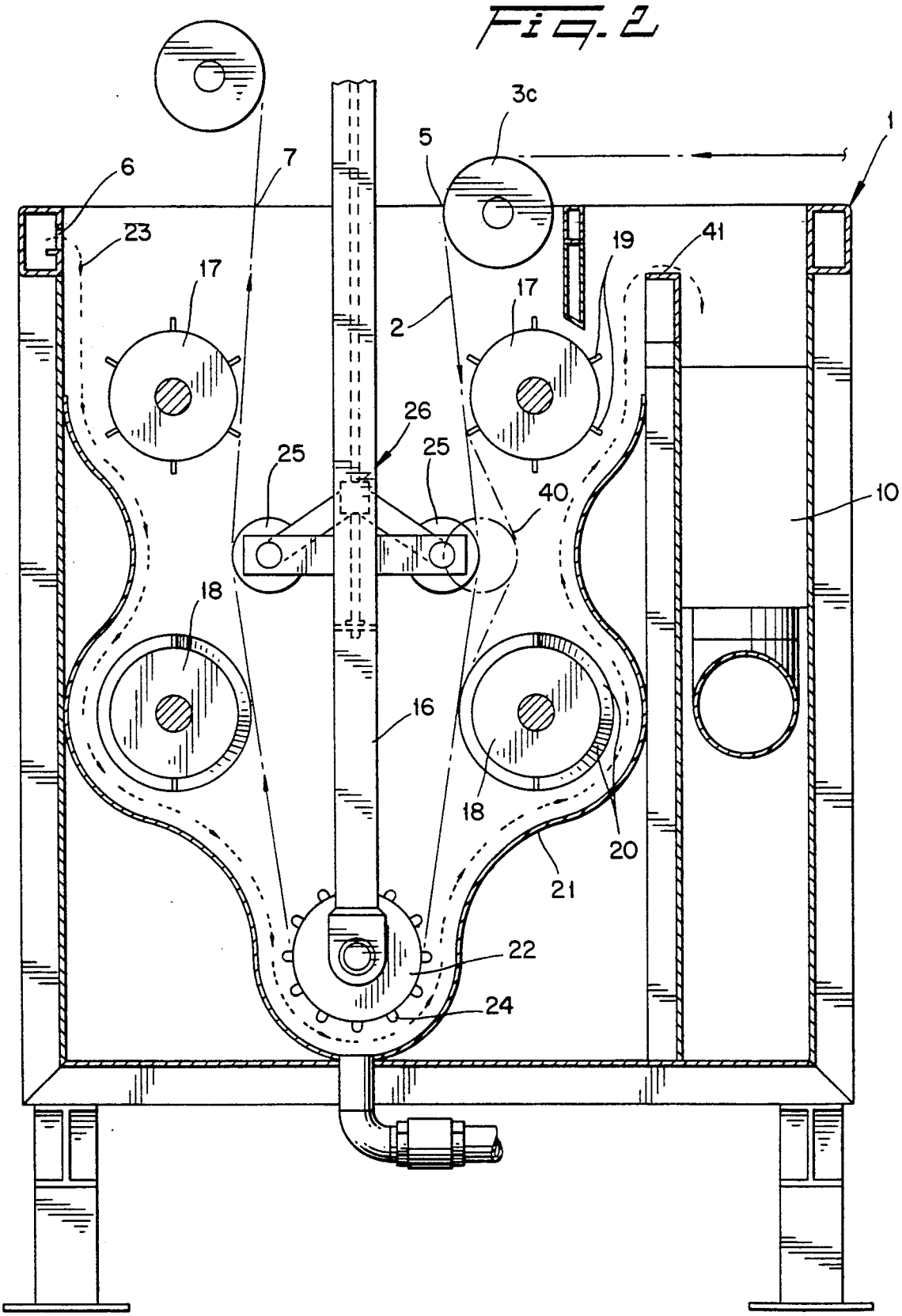
FIG. 2 is a detailed cross-section of the interior of the main tank.
Figure 6:
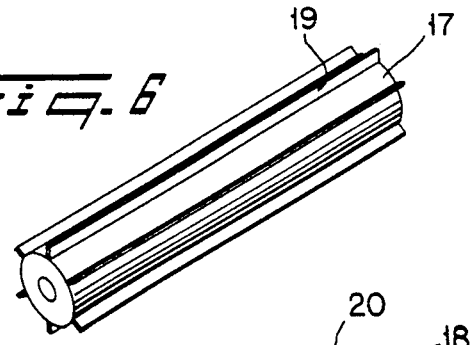
FIG. 6 is a detail of the parallel fin roll.
Figure 7:
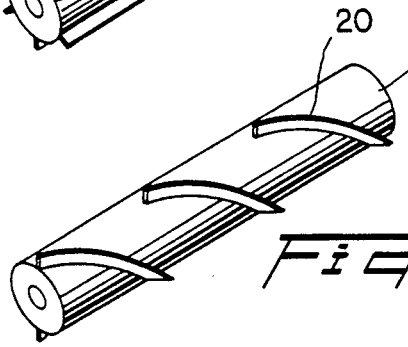
FIG. 7 is a detail of the spiral fin roll.
Figure 8:
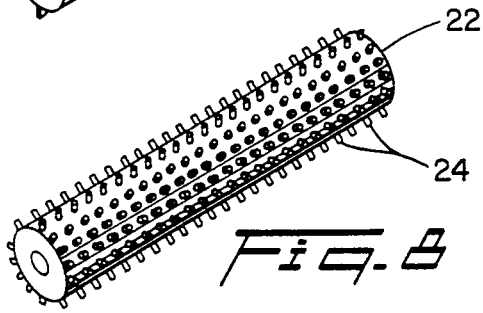
FIG. 8 is a detail of the guide roll.

Referring now to the accompanying drawings, and initially to FIGS. 1 and 2, there is shown generally the apparatus according to the invention as preferably embodied for washing continuously fed carpet and mechanically modifying the pile thereof. FIG. 1 shows a general side elevation of the apparatus 1 in position relative to the continuous path 2 of the carpet.

The carpet travels the path 2 in the direction of the arrows around the guide rollers 3*a–c* from operations prior to the washing and pile manipulation, through the apparatus 1 of the invention and around guide rollers 3*d–g* to post washing treatment, such as dyeing.

The carpet enters the main tank 4 at entrance point 5 for treatment by a processing liquid primarily comprising hot water. Additional chemicals such as wetting agents, lubricants, etc. may be steadily added to the processing liquid prior to its introduction to the main tank 4 at inlet weir 6. Above the exit point 7 of the carpet are a pair of squeeze rollers 8 between which the carpet passes for removal of most of the processing liquid remaining on the carpet. Subsequent to the squeeze rollers 8, the carpet passes a vacuum extraction means 9 and is carried away for further processing. The vacuum extraction means 9 removes any processing liquid remaining on the carpet after passage through the squeeze rollers 8.

Points 11 and 12 represent the positions within the main tank 4 of the manipulation rollers and point 13 represents the relative position of the bottom guide roller of the guide and tension roller assembly that is retractable from the main tank 4 by means of track 14 and lifting means 15. The positioning of these rollers and their relationship with the inner wall of the tank 4 are important with regard to achieving optimum fluid flow in the tank and proper modification of the carpet pile. In this regard, FIG. 2 illustrates the interior of the tank 4 with the guide and tension roller assembly 16 in place.

Within the tank are two pairs of finned manipulation rollers 17 and 18, the rollers of each pair being identical and on opposite sides of the guide and tension roller assembly 16. Preferably, the upper rollers 17 have radially extending fins 19 that are parallel to the longitudinal axis of the rollers themselves. These fins 19 lift the pile yarn at a right angle to the direction of carpet travel. The lower rollers 18 have fins 20 which are longitudinally spiralled so as to brush the pile at an angle of 20 to 30 degrees. It is important that the direction of the spiral of the fins 20 of one roller be opposite to that of its mate so that the carpet pile is brushed first in one direction then in the opposite direction. Fin roller pairs 17 and 18 are preferably driven by separate drive means, represented by 11' and 12' in FIG. 1, and may operate at variable speeds, preferably up to 100 revolutions per minute, in either clockwise or counter clockwise rotation.

As shown in FIG. 2, the interior wall 21 of the tank 4 is contoured, the contour following the circumferences and positions of the rollers 17 and 18 and the guide roller 22. This contouring assists the rollers 17, 18 and 22 in maintaining a proper circulation of the processing liquid in a flow opposite to the travel of the carpet. The carpet direction is shown by the line 2 entering the tank 4 at point 5 over roller 3*c*, continuing downward around guide roller 22, then upward to exit the tank at point 7 and pass between the squeeze rollers 8.

Processing liquid enters the tank through inlet weir 6 and follows a general circulation pattern as indicated by path 23 around the tank to exit at an outlet weir 41 into side vessel 10. Within the side vessel 10 there is preferably a means to filter the fiber from the processing liquid before it is recirculated to the tank 4 or directed to a drain.

Guide roller 22 is situated at the lower end of the guide and tension roller assembly 16. In addition, the surface of guide roller 22 is studded with a plurality of short projections or nodules 24 which press into the back of the carpet as it passes around guide roller 22, thereby causing the pile fibers to lift outward and separate. When the assembly 16 is fully inserted into the tank 4, guide roller 22 also cooperates with the contoured inner wall 21. Lowering of this assembly 16 into the tank 4 pushes the carpet down into the processing liquid and into a position to be acted upon by rollers 17 and 18. Tension rollers 25 are extendable by a drive and link means 26 to an outer position 40 where they press against the backside of the carpet to urge the pile side into contact with the manipulation rollers 17 and 18. The positioning of the tension rollers 25 is such that they are located vertically between the upper rollers 17 and lower rollers 18.

The guide and tension roller assembly 16 is shown in greater detail in FIGS. 3 and 4. Specifically, the guide and tension roller assembly comprises the guide roller 22 and tension rollers 25 with associated drive and link means 26 all mounted on a vertically adjustable frame 27. This frame 27 is guided in its vertical movement by track means 14 within the tank 4 and extending upwards above the tank 4 to allow the assembly 16 to completely clear the tank 4 when fully raised, there being upper and lower guide plates 39 on frame 27 to maintain proper registration of the assembly 16 with track 14. Means 15 are provided above the tank 4 to raise and lower the assembly 16.

As noted previously, the tension rollers 25 are extendable outwards by a drive and link means 26. Preferably this comprises a vertical shaft 28 that is rotatably driven through a right-angle gear box 29 by a power shaft 30. Mounted on the shaft 28 for vertical travel thereon in response to shaft rotation is a nut 31. Link arms 32 connect the nut 31 to tension rolls 25 on either side of the frame 27. The connections of the link arms 32 to the nut 31 and the tension rollers 25 are free to pivot. The ends of the tension roller shafts 33 are confined in horizontal guide tracks 34 which extend laterally from the frame 27. In operation, power shaft 30 drives vertical shaft 28 through gear box 29. Depending on the direction of rotation, nut 31 will travel vertically up or down with link arms 32 converting the vertical motion of the nut 31 to horizontal motion of the tension rollers 25 by virtue of the latters' confinement in the guide tracks 34.

Figure 5:
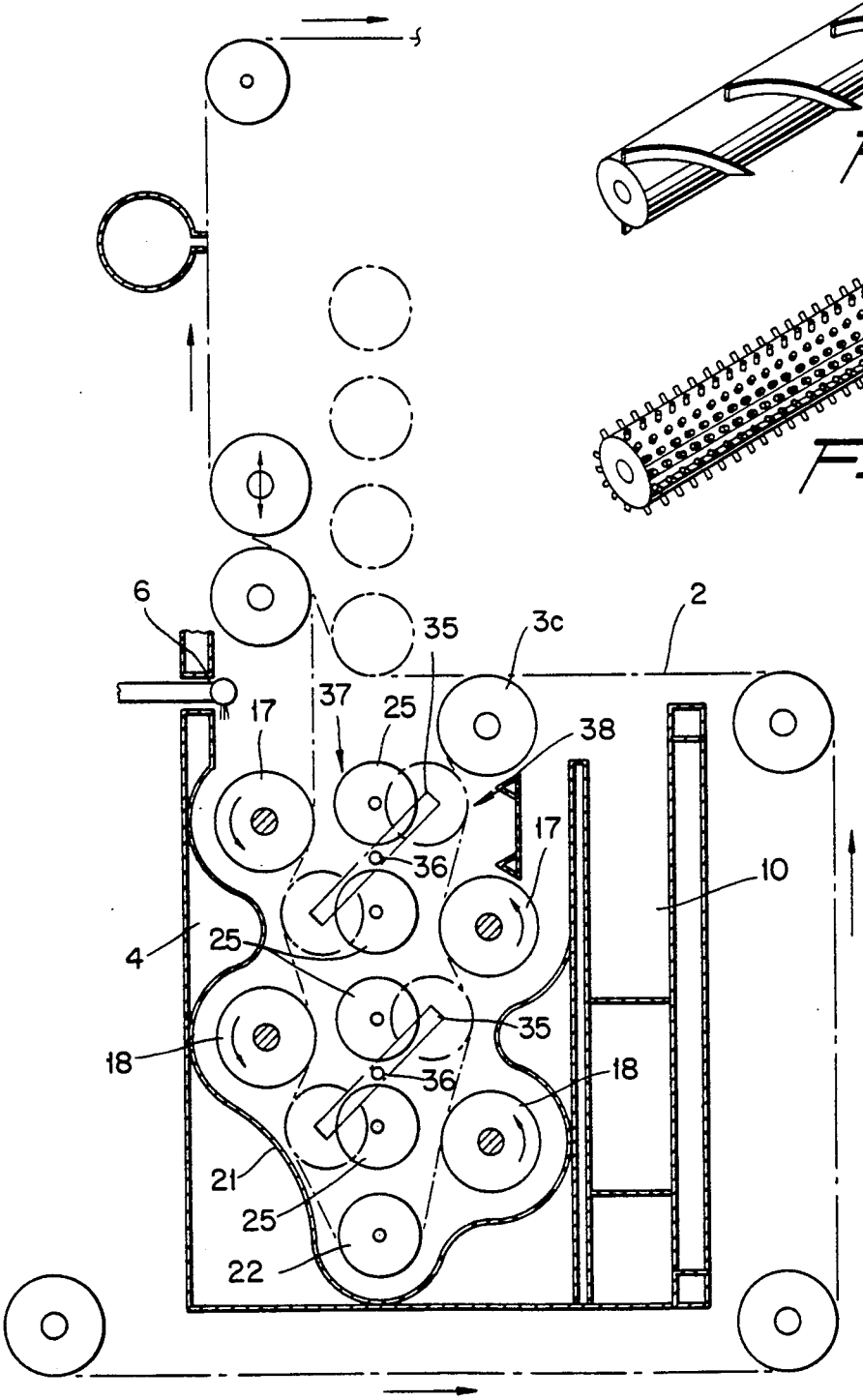
FIG. 5 is a detailed cross-section of the interior of a second embodiment of the main tank.

In an alternative embodiment depicted in FIG. 5, the tension rollers 25 are mounted at opposite ends of swing arms 35 that pivot at a central point 36. A drive means is provided to pivot the tension roller assembly of this embodiment from the at-rest vertical position 37 to the operative semi-horizontal position 38 shown in dotted lines in FIG. 5. This Figure also shows an alternative embodiment for the relative arrangement of the fin rollers 17 and 18 as horizontally staggered rather than directly opposite each other.

In use, the continuous carpet fabric is threaded around the mill guide rollers and over the tank portion of the apparatus of this invention such that the pile surface is downward. The guide and tension roller assembly is lowered into the tank pushing the carpet in with it, the guide and tension roller assembly contacting the back surface of the carpet. The tension rollers are extended or pivoted into place thereby bringing the pile surface into contact with the fin rollers. Upon activation of the drive means for the fin rollers, their rotation causes the fins to contact the fibers of the carpet pile. Specifically, the parallel fin rollers work to lift the pile yarn at right angles to the carpet flow while the spiral fin rollers brush the pile at an angle first in one direction then in the opposite direction. In addition, the nodules on the surface of the bottom guide roller contact the non-pile back surface of the carpet putting tension against the back of the carpet which acts to push the pile outward further equalizing the tension and spacing of the pile yarns. All of this manipulation is conducted in a processing liquid that is primarily hot water but may include lubricants, detergents, surfactants and the like. The processing liquid flows through the apparatus in a direction that counters the direction of travel of the carpet for increased contact and washing action. Following treatment in this manner, the excess processing liquid is removed by squeeze rollers and vacuum and the carpet travels on for further processing. In this manner, the tension and spacing of the pile yarns is equalized resulting in improved dyeing and optical appearance of the final product.

Furthermore, the mechanical action of the fin rollers on the pile and the spreading of the pile as the carpet passes around the bottom guide roller serve to free any loose fibers or lint from the carpet. These fibers or lint are removed from the processing liquid as it passes through the filter in the side vessel. Removal of such fibers and lint also contributes to the improvement in dyeing and optical appearance of the carpet.

The present invention has been described in detail above for purposes of illustration only and is not intended to be limited by this description or otherwise to exclude any variation or equivalent arrangement that would be apparent from, or reasonably suggested by the foregoing disclosure to one of skill in the art.

What is claimed is:

1. An apparatus for washing and mechanically treating a continuous travelling web having a backing surface and a pile surface, said apparatus comprising a processing tank receivable of a processing liquid, guide means directing said web through said tank in a first direction in a substantially U-shaped path with the pile surface directed outward, means within said tank for manipulating said pile surface of said web, processing liquid inlet means located adjacent the exit point of said web from said tank, processing liquid outlet means located adjacent the entrance point of said web into said tank, filtering and recirculating means for said processing liquid, said processing tank having an interior wall that is contoured relative to said manipulating means, whereby circulation of said processing liquid is maintained in an agitated and substantially counter current flow to the direction of travel of said web.

2. The apparatus of claim 1 wherein the means for manipulating the pile surface of said web comprises at least two elongated rollers extending perpendicular to the direction of travel of the web and having driving means imparting rotation to said rollers relative to the surface of said web wherein said rollers have projections extending radially from the surface thereof which projections contact and manipulate said pile surface.

3. The apparatus of claim 2 wherein said rollers rotate in opposite directions and the speed of said drive means is variable.

4. The apparatus of claim 2 wherein the projections comprise a plurality of elongated fins parallel to the longitudinal axes of said rollers and spaced about the circumference thereof.

5. The apparatus of claim 2 wherein the projections comprise a plurality of elongated fins arranged in a continuous longitudinal spiral about the circumference of said rollers, the angle of the spiral being 20° to 30° relative to the longitudinal axes of said rollers and the direction of the spiral on one roller being opposite to the direction of the spiral on the other roller.

6. The apparatus of claim 1 wherein the means for manipulating the pile surface of said web comprises first and second pairs of rotatably driven elongated rollers extending perpendicular to the direction of travel of said web and having substantially radial projections thereon, said first pair of rollers being positioned in an upper portion of said tank and said second pair of rollers being positioned in a lower portion of said tank, the rollers of each pair being situated on opposite sides of the interior of said tank such that the web in its passage through said tank is acted upon by the first roller of said first pair, the first roller of said second pair, the second roller of said second pair and the second roller of said first pair in that order, the guide means being located between the first and second rollers of each pair when said apparatus is in use.

7. The apparatus of claim 6 wherein said guide means comprises a frame having adjustable tension means, means to adjust the position of said tension means, and a lower guide roller mounted thereon, said adjustable tension means comprising at least two rollers, one on either side of said frame, that are extendable from said frame to contact the backing surface of said web thereby urging the pile surface of said web into contact with said manipulating rollers and said lower guide roller having a plurality of individual radial projections on its surface.

8. The apparatus of claim 6 wherein the substantially radial projections on said manipulating rollers comprise a plurality of elongated fins, the fins on said first pair of rollers being parallel to the longitudinal axes of said rollers and the fins on said second pair of rollers being arranged in a longitudinal helix about the circumference of said rollers with the angle of said helix being 20° to 30° relative to the axes of said rollers and the direction of said helix on the first roller being opposite to that of the helix on the second roller.

9. The apparatus of claim 7 having means comprising vertical tracks and lifting means for vertically raising and lowering said guide means relative to said tank, said vertical tracks extending from within said tank to a point above said tank that is at least substantially equal to the length of said guide means, said frame having means cooperating with said tracks to maintain the horizontal position of the guide means relative to the tank.

10. An apparatus for washing and mechanically treating a continuous travelling carpet web having a backing surface and a pile surface said apparatus comprising, a processing tank receivable of processing liquid and having a contoured interior surface, guide means, selectively contactable with said backing surface of said web, for directing said web through said tank, a first pair of manipulating rollers positioned in the upper portion of said tank, said first pair of rollers having radially extending longitudinal fins positioned about the circumference of said rollers parallel to the axes of said rollers, a second pair of manipulating rollers positioned in the lower portion of said tank, said second pair of rollers having radially extending fins arranged in a continuous longitudinal helix about the circumference of said rollers at an angle of 20° to 30° relative to the axes of said rollers, the direction of the helix on one roller of said pair being opposite to that on the other roller of said pair, said first and second pairs of manipulating rollers having means to effect rotation thereof relative to said pile surface of said carpet web such that said fins brush said pile surface, the direction of said rotation being variable and the speed of said rotation being variable up to 100 rpm, said guide means having a plurality of adjustable tension rollers and a lower guide roller, the surface of said lower guide roller having a plurality of radial projections thereon, and said contoured interior surface of said tank conforming to the positions of said first and second pairs of manipulating rollers and cooperating therewith to define a channel around the periphery of the tank for circulation of said processing liquid.

11. The apparatus of claim 7 wherein said means to adjust the position of said tension rollers comprises a vertical driven shaft, means for rotatably driving said shaft, a traveling nut vertically drivable along said shaft in response to rotation of said shaft, link means connecting said nut to said tension means and horizontally extending track means for guiding said tension rollers, whereby rotation of said shaft produces vertical movement of said nut translated to horizontal movement of said tension rollers along said track means by said link means.

12. A method for washing and mechanically treating carpet pile to eliminate optical banding and loose fibers in dyed carpet comprising introducing a continuous web of pile carpet into a tank containing a processing liquid, contacting said pile with rotating finned rollers to lift and brush said pile at an angle relative to the direction of travel of said web, applying mechanical tension to said web to equalize tension and spacing of said pile, contacting said pile with rotating finned rollers to lift and brush said pile at a further angle relative to the direction of travel of said web, removing said web from said tank, and removing excess processing liquid from said web.

13. The method of claim 12 wherein said washing and treating is conducted in a continuous manner before dyeing said carpet.

14. The method of claim 12 wherein said web passes through said tank in a substantially U-shaped continuous path with the pile surface outward and wherein tension means positioned within the U formed by said web press against the back of said web to urge said pile surface into contact with said finned rollers.

15. The method of claim 12 wherein the mechanical tension applied to said web is applied at the bottom of the U formed by said web by a guide roller having a plurality of individual projections extending radially from its outer surface wherein said projections press into the back of said web to stretch the pile outward.

16. The apparatus of claim 6 wherein said first and second pairs of rollers have separate drive means for imparting rotation thereto, said drive means being independently variable to vary the speed of said rollers of each pair.

* * * * *